United States Patent [19]

Ritter

[11] Patent Number: 5,005,287

[45] Date of Patent: Apr. 9, 1991

[54] PROCESS FOR MAKING A HYDROPHILIC COATING ON A FORMED PART AND SAFETY RAZOR MADE USING THIS PROCESS

[75] Inventor: Helmut Ritter, Wuppertal, Fed. Rep. of Germany

[73] Assignee: Wilkinson Sword GmbH, Solingen, Fed. Rep. of Germany

[21] Appl. No.: 190,628

[22] Filed: May 5, 1988

[30] Foreign Application Priority Data

May 6, 1987 [DE] Fed. Rep. of Germany ..... 3714971
Apr. 27, 1988 [DE] Fed. Rep. of Germany ..... 3814135

[51] Int. Cl.[5] ..... B26B 21/44
[52] U.S. Cl. ..... 30/41; 30/90
[58] Field of Search ..... 30/41, 90; 83/14, 22; 427/44, 54.1; 428/500; 522/27, 30

[56] References Cited

U.S. PATENT DOCUMENTS

| | | | |
|---|---|---|---|
| 4,092,173 | 5/1978 | Novak et al. | 427/44 |
| 4,100,309 | 7/1978 | Micklus et al. | 427/2 |
| 4,105,519 | 8/1978 | Pennewiss et al. | 522/27 |
| 4,119,094 | 10/1978 | Micklus et al. | 128/132 R |
| 4,170,821 | 10/1979 | Booth | 30/41 |
| 4,171,979 | 10/1979 | Novak et al. | 427/44 |
| 4,308,120 | 12/1981 | Pennewiss et al. | 522/30 |
| 4,378,411 | 3/1983 | Heilmann et al. | 428/500 |
| 4,537,805 | 8/1985 | Lin | 427/54.1 |
| 4,624,051 | 11/1986 | Apprille et al. | 30/41 |

FOREIGN PATENT DOCUMENTS

| | | | |
|---|---|---|---|
| 2024082 | 1/1980 | United Kingdom | 30/41 |

OTHER PUBLICATIONS

U.S. patent application Ser. No. 931,399, filed Nov. 14, 1986.

U.S. patent application Ser. No. 07/285,175 filed Dec. 16, 1988.

*Primary Examiner*—Douglas D. Watts

*Attorney, Agent, or Firm*—Finnegan, Henderson, Farabow, Garrett & Dunner

[57] ABSTRACT

Process for forming and applying a hydrophilic coating, which is highly slideable when wet, to a plastic or metal part either directly, or indirectly via plastic film, to a safety razor or razor blade unit, in which a solution containing a water-soluble polymer is applied to the plastic or metal part and is cured. The invention also relates to a razor blade unit comprising a blade platform for at least one razor blade, a surface for slidably engaging the skin of a user and a coating on the surface for increasing the slideability of the surface. The coating comprises a water-soluble polymer or copolymer of poly-N-vinylpyrrolidone, at least one radically polymerizable vinyl monomer and a photoinitiator.

15 Claims, 1 Drawing Sheet

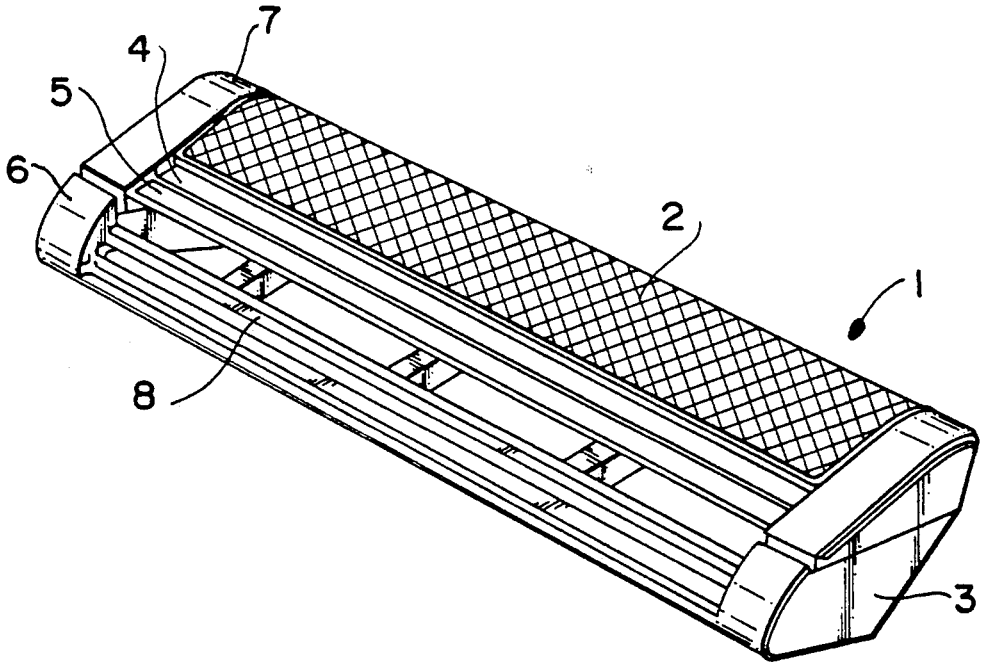
7
4
5
6
2
1
8
3

PROCESS FOR MAKING A HYDROPHILIC COATING ON A FORMED PART AND SAFETY RAZOR MADE USING THIS PROCESS

The invention concerns a process for forming and applying a hydrophilic coating, which is highly slidable when wet, to a plastic or metal part, in particular safety razor or razor blade unit, in which a solution containing a water-soluble polymer, in particular polyvinyl pyrrolidone, ("PVP") is applied to the part and is cured there. The invention also concerns a safety razor or a razor blade unit with at least one razor blade held on a blade platform and a surface adjacent to the razor blade which runs over the skin of the user while shaving, in particular a cap, of plastic, such as polystyrene or Acrylonitrile Butadiene Styrene ("ABS") or of metal, with a device for increasing the slidability.

A safety razor of plastic is known from DE-OS 28 51 457, in which at least one razor blade is arranged between a razor blade platform and a cap. The safety razor head has an integral, solid and water-soluble shaving aid. The shaving aid is in the form of a strip of the solid, though water-soluble material, the strip being arranged in a position adjacent to the razor blade and fastened either to the blade platform or the cap. A microencapsulated silicone oil, polyethylene oxide, a nonionic polyacrylamide or a polysaccharide is envisaged as the water-soluble material. The aim is to achieve a perfect wet shave through the shaving aid in contact with the moist skin or if necessary by wetting the safety razor head itself being immediately at each shave newly applied to the skin, so that its sliding properties act continuously throughout the shaving process.

The disadvantage with the known safety razor is that the substance acting as lubricant is dissolved out of the carrier and deposits itself on the skin of the user in the form of a film. There is thus the danger of causing skin irritation as well as the need to subsequently wash off the film of lubricant that has already dried on the areas already shaved, which can be difficult depending on the degree of hardness of the water available. In addition, the design of the safety razor with the plastic strip arranged in a recess is expensive and it is not possible to move the strip really (or locate) near to the cutting edge of the razor blade. In principle therefore the known sliding strip can only be positioned in one place on the safety razor, which is unfavourable for the desired properties in use.

From DE-PS 28 28 617 is also known a part of a polymer substrate and a coating layer applied to this substrate the latter consisting of a polyvinyl pyrrolidone-polyurethane interpolymer. Various uses are mentioned for such a part, such as contact lenses, catheters, peristaltic pump chambers, condomes, etc., when it is desirable to use a material such as polyurethane, a polyacrylate or a vinyl resin which when damp has a lower coefficient of friction than is otherwise possible with such materials. In contrast with medical technology there are no such demands in the case of conventional safety razors, nor is it customary to use such materials, in particular a polyurethane. Safety razors and razor blade unit are made rather of polystyrene which is not comparable in its properties. In particular a coating applied by the process as in DE-PS 28 28 617 would not adhere on polystyrene. It is in fact proposed there applying the solution of a polyisocyanate to the substrate and after evaporation of the solvent applying a solution of polyvinyl pyrrolidone to the substrate thus treated to obtain a polyvinyl pyrrolidone-polyurethane interpolymer. Also a disadvantage with this process is that it is a time-consuming process to form such a coating layer, as the individual components are applied from diluted solutions, the solvents are evaporated slowly and free isocyanate groups are made to react at an elevated temperature. If this complicated process were transferred to the manufacture of safety razors, there would be the danger of stress cracks occurring or of deformation processes being initiated. Finally this method cannot be applied to the manufacture of safety razors because only 10% to 15% of the solution does not evaporate in the course of the manufacturing process, so that only extremely thin coating thicknesses can be achieved for the sliding coating. The coating thicknesses are also extremely difficult to check and application onto round surfaces at least is difficult. Control of the curing process by evaporation must also take place very slowly and carefully so that the process occurs from the inside out so that unwanted substances do not remain entrapped in the end product, which would leach out during shaving and remain on the skin.

The invention is based on the problem of improving a process of the kind mentioned at the start while avoiding the above disadvantages to enable the manufacture of parts in plastic or metal of high slidability when moist, in particular safety razors or razor blade units or their parts, whereby the coating is also to adhere well on polystyrene or ABS or metal and is to be applied and cured in a short time. The invention is in particular based on the objective of improving the sliding properties of a safety razor in the area close to the blade in a way that excludes substances in the nature of a lubricant being deposited on the skin.

The problem has been solved according to the invention in that the solution to be applied to the part consists of a water-soluble polymer, in particular poly-N-vinyl pyrrolidone or a copolymer thereof, one or more radically polymerizable vinyl monomers and a photoinitiator disintegrating into radicals on irradiation and that the applied solution is exposed to UV radiation for curing. The solution then quickly cures into a controlled thickness of coating with good adhesion, which when wet has a greatly reduced coefficient of friction on contact with the skin. The solution preferably contains 0.1 to 90% w/w polyvinyl pyrrolidone, in particular 5 to 30% w/w polyvinyl pyrrolidone, in relation to the vinyl monomers used. The mean molecular weight of polyvinyl pyrrolidone can have different values from 15,000 to 600,000 g/mol, preferably 200,000 to 500,000 g/mol.

Instead of using pure polyvinyl pyrrolidone, which is particularly suitable, copolymers of pyrrolidone can also be used with e.g. maleinates or acrylates within the meaning of the invention. Other water-soluble polymers, such as polymers containing polyvinyl alcohol, polyacrylamide, or polysaccharides or polyethylene oxide as additive.

Suitable radically polymerizable vinyl monomers within the meaning of the invention are mostly acrylic acids, methacrylic acid and their derivatives as well as mixtures of styrene and polyester resins containing maleic acid or fumaric acid. Examples are acrylates or methacrylates containing cyclic or open-chain ether groups, such as esters of single or multiple ethoxylated or propoxylated $C_1$-$C_{20}$ alcohols, tetrahydrofuran ("THF") carbinol acrylate or THF carbinol methacrylate, hydroxyalkyl esters, such as 2-hydroxyethyl acrylate, 2-hydroxyethyl methacrylate, 2-hydroxypropyl acrylate or 2-hydroxypropyl methacrylate, N,N-dimethylamino-2hydroxyethyl acrylate, N,N-dimethyl lamino-2-hydroxyethyl acrylate, N,N-dimethylamino-ethyl methacrylate or salts thereof, such as N,N,N-trimethylammonium-2-ethyl methacrylate chloride, also acrylamide, N-alkylacrylamide with 1-10 C atoms in the alkyl group, N-2-hydroxyethyl acrylamide, N-2-hydroxypropyl acrylamide or methacrylamide, N-2-hydroxyethyl methacrylamide, N-2-hydroxypropyl methacrylamide, acrylonitrile and methacrylonitrile.

The polyester resin systems which are also suitable contain maleic acid or fumaric acid as well as e.g. phthalic acid, adipic acid, sebacic acid and hydrophilic polyether dioles, such as diethylene glycol, oligoethylene glycol with 3-1000 ethylene oxide building blocks, oligopropylene glycol with 1-1000 propylene oxide building blocks, also ethylene glycol, butandiole, trimethylolpropane or ethoxylated trimethylolpropane with 3-60 ethylene oxide components as well as ethoxylated and/or propoxylated trimethylol propane with 0-60 propyl oxide components.

Preferably there are present in the hydrophilic vinyl monomer mixtures components from 0-80% w/w, in particular 0.5 to 50% w/w of hydrophobic monomers, such as methylmethacrylate, butyl acrylate, ethyl acrylate, cyclohexyl acrylate or ethyl hexylacrylate. Urethane modified acrylic esters and methacrylic esters can also be used, which are obtained in known fashion e.g. by the conversion of 2-isocyanate ethylmethacrylate with various $C_1$ to $C_6$ alcohols, in particular methanol, ethanol or butanol, alkoxy alcohols, such as ethoxylated and/or propoxylated methyl, ethyl, propyl, butyl, hexyl or ethyl hexyl alcohol, or by conversion of hydroxyalkyl acrylates or hydroxyalkyl methacrylates with aromatic or aliphatic mono, di or triisocyanates, such as hexamethylene diisocyanate, lysine methacr diisocyanate, toluol diisocyanate, diphenylmethane-4,4' diisocyanate ("MDI") or an adduct from trimethylol propane and 3 mol toluol diisocyanate. N-vinyl pyrrolidene in the hydrophilic vinyl monomer mix, which is particularly suitable as an additive within the meaning of the invention, can also be used.

Although multifunctional vinyl compounds are not absolutely necessary within the meaning of the invention, the addition in a quantity from 0 to 80% w/w, preferably up to 50% w/w, similarly leads to good results in quality. Suitable cross-linking components are for example butandiole bisacrylate, 1,6-hexenediole bisacrylate, oligoethylene glycol bisacrylate with 1 to 400 ethylene glycol units, acrylates or methacrylates of trimethylol propane or ethoxylated and/or propoxylated trimethylolpropane. Similarly suitable is bis(2 hydroxy ethyl) bisphenol-A-dimethacrylate or an adduct from (meth)acrylic acid and bisphenol-A-diglycide ether or urethane modified bisacrylates.

The mixtures mentioned to be applied to the part can be made with a solvent which has a favourable effect on the working properties of the system. Suitable solvents are acetone, methyl ethyl ketone, methanol, ethanol, propanol, butanol, ethyl acetate, butyl acetate, methylene chloride, toluol, THF, water and mixtures thereof.

Photoinitiators can be used in the vinyl monomer mix in an effective quantity from 0.01 to 5% w/w, in particular 0.1 to 5% w/w and preferably in a quantity from 0.3 to 1% w/w. Compounds are used which disintegrate into radicals from UV radiation. Effective photoinitiators for example are the known compounds benzophenone, acetophenone, fluorenone, benzaldehyde, propiophenone, anthraquinone, carbazol, 3 or 4-methylacetophenone, 3 or 4-methoxybenzophenone, 4,4'-dimethoxybenzophenone, allylacetophenone, 2,2'-diphenoxyacetophenone, benzoin, methylbenzoin ether, ethylbenzoin ether, propylbenzoin ether, benzoin acetate, benzoinphenyl carbamate, benzoin acrylate, benzoinphenyl ether, benzoyl peroxide, dicumyl peroxide, azo isobutyronitrile, phenyl disulphide, acyl phosphene oxide or chloromethyl anthraquinone as well as mixtures thereof.

In addition to the photoinitiator it is also possible to add 0.3 to 5.0% w/w of an activator to the coating system. Suitable activators are for example mercaptoacetic acid, organic amines, such as n-decylamine, piperazine, morpholine, tributylamine, benzylamine, allylamine, polyethylenimine and/or piperidine.

The safety razor and razor blade unit in accordance with the invention are characterized in that the device increasing slidability consists of a 5 to 1000 μm thick layer of a mixture of water-soluble polymers cured by UV radiation, in particular poly-N-vinyl pyrrolidones or a copolymer thereof, one or more radically polymerizable vinyl monomers and a photoinitiator disintegrating into radicals on irradiation. Further configurations of this slidability layer can be seen from the summaries of substances listed above. The particular advantage is that the coating of the safety razor, safety razor head or razor blade unit can cover a large area, in fact even the whole area of the polystyrene or ABS or metal support or subsequently to be glued on PVO film, the thickness of the layer thereby being very easily adjustable, that the volume of the applied solution does not change during the curing process so that the applied thickness of coating is retained. Even relatively thick coatings can be formed by adjusting the viscosity of the solution, without leading to uncontrolled flowing off of the solution after application and thus to a change in the thickness of coating. The coating also adheres extremely well to the polystyrene or ABS used in safety razors normally as plastic parts, and also on metal surfaces so that producing the sliding coating appears simple.

Further details, features and advantages of the subject matter of the invention can be seen from the following description in the accompanying examples and from the drawing, in which a safety razor in accordance with the invention is shown schematically.

EXAMPLE 1

A mixture of 2.40 g tetrahydrofuranyl-2-methylacrylate, 0.05 g photoinitiator (Darocur 1116, Merck), 0.25 g polyvinyl pyrrolidone and 0.05 g tetraethylene glycol diacrylate is applied to a polystyrene support with a brush and the coating then irradiated with an 80 W UV lamp for 15 min at a distance of 5 cm. The cured coating has when moistened a very much reduced frictional resistance. Sliding friction of a leather disk that is pressed against the coated surface with 1 kg/8 $cm^2$:

| | |
|---|---|
| dry | 350 CN |
| wet | 180 CN |

EXAMPLE 2

A mixture of 2.4% g tetrahydrofuranyl-2-methylacrylate, 0.05 g photoinitiator (Darocur 1116) and 0.25 g polyvinyl pyrrolidone is applied to a polystyrene support with a sponge and the coating then irradiated with an Hg UV lamp for 30 min at a distance of 10 cm. The cured coating has when moistened a very much reduced coefficient of friction. Sliding friction of a leather disk that is pressed against the treated and cured surface with a pressure of 1 kg/8 $cm^2$:

| | |
|---|---|
| dry | 360 CN |
| wet | 200 CN |

EXAMPLE 3

2.30 g tetrahydrofuranyl-2-methylacrylate, 0.20 g photoinitiator and 0.25 g polyvinyl pyrrolidone are mixed, applied to a polystyrene support with a roller and then irradiated with an 80 W UV lamp for 15 min at a distance of 5 cm. The frictional resistance of the cured coating is reduced to a great extent by moistening. Sliding friction of a leather disk that is pressed against the cured surface with a pressure of 1 kg/8 $cm^2$:

| | |
|---|---|
| dry | 350 CN |
| wet | 210 CN |

EXAMPLE 4

10 g N-vinyl pyrrolidone, ("NVP") 10 g trimethylol propane monoacrylate (Roskydal KL 5-2475, Bayer) are mixed with 4 g PVP and 0.75 g photoinitiator (Darocur 1116, Merck), applied with a blade to a support of ABS or a PVO film and irradiated with an 80 W UV lamp for 3 min at a distance of 5 cm.

A highly slidable surface is obtained when wet.

| | |
|---|---|
| Coefficient of friction dry | 330 CN |
| Coefficient of friction wet | 80 CN |

EXAMPLE 5

5 g NVP and 5 g trimethylol propane monoacrylate are mixed with 2 g PVP and 0.18 g photoinitiator (Lucirin LR 8728, BASF), applied with a blade to a support of ABS or a PVO film and irradiated with an 80 W UV lamp for 45 sec at a distance of 5 cm.

A surface is similarly obtained whose frictional resistance is greatly reduced by moistening.

| | |
|---|---|
| dry | 340 CN |
| wet | 100 CN |

The safety razor 1 shown in perspective in the only figure of the drawing has a razor blade unit 3 attachable to a handle, in which are arranged in conventional fashion two razor blades 4, 5 between a razor blade holder 6 and a cap 7. A guardbar 8 is arranged on the razor blade carrier, which is ribbed in the customary fashion. The whole cap 7 and if necessary guide surface is given a sliding coating 2, shown hatched in the drawing, which is applied in accordance with one of the abovementioned examples 1 to 3 and consists of the said preferred mixtures of substances.

I claim:

1. The razor blade unit of claim 15, wherein the coating on the surface is cured.

2. The razor blade unit of claim 15, wherein the poly-N-vinylpyrrolidone is present an amount ranging from about 0.1 to 90% by weight.

3. The razor blade unit of claim 2, wherein the poly-N-vinylpyrrolidone is present in an amount ranging from about 5 to 30% by weight.

4. The razor blade unit of claim 15, wherein the mean molecular weight of the poly-N-vinylpyrrolidone is from about 200,000 to 500,000 g/mol.

5. The razor blade unit of claim 15, wherein the vinyl monomer is an acrylic acid, a methylacrylic acid or a derivative thereof.

6. The razor blade unit of claim 15, wherein the vinyl monomer is a mixture of acrylic acid derivatives with N-vinylpyrrolidone or a mixture of polyester resins containing styrene and maleic or fumaric acid.

7. The razor blade unit of claim 6, wherein the vinyl monomer mixtures comprise up to 80% by weight of a hydrophobic methacrylate, butyl acrylate, ethyl acrylate, cyclohexyl acrylate and ethyl hexyl acrylate.

8. The razor blade unit of claim 7, wherein the hydrophobic monomer is present in an amount ranging from about 0.5 to 50% by weight.

9. The razor blade unit of claim 15, wherein the vinyl monomer is a urethane modified acrylic or methacrylic ester.

10. The razor blade unit of claim 15, wherein the photoinitiator is present in an amount ranging from about 0.01 to 5% by weight.

11. The razor blade unit of claim 15, wherein the photoinitiator is present in an amount ranging from about 0.3 to 5% by weight.

12. The razor blade unit of claim 15, wherein the coating further comprises a multi-functional vinyl compound which is present in an amount up to 50% by weight.

13. The razor blade unit of claim 15, wherein the coating further comprises a photoactivator present in an amount ranging from about 0.3 to 5% by weight.

14. The razor blade unit of claim 15, wherein the photoactivator is a mercaptoacetic acid, an organic amine, or a mixture thereof.

15. A razor blade unit comprising a blade platform for at least one razor blade, a surface for slidably engaging the skin of a user, and a coating on the surface for increasing the slidability of the surface, wherein said coating comprises a water-soluble polymer or copolymer of poly-N-vinylpyrrolidone, at least one radically polymerizable vinyl monomer and a photoinitiator.

* * * * *

UNITED STATES PATENT AND TRADEMARK OFFICE

CERTIFICATE OF CORRECTION

PATENT NO. : 5,005,287

DATED : April 9, 1991

INVENTOR(S) : HELMUT RITTER et al.

It is certified that error appears in the above-identified patent and that said Letters Patent is hereby corrected as shown below:

In the title page:

Item [75] "Inventors, should read "Helmut Ritter, Wolfgang Althaus, Jochen Thone, all of Fed. Rep. of Germany".

Claim 7, line 3, after "hydrophobic" insert --monomer selected from the group consisting of methyl--.

Signed and Sealed this

Thirteenth Day of October, 1992

*Attest:*

DOUGLAS B. COMER

*Attesting Officer*

*Acting Commissioner of Patents and Trademarks*